US008550834B2

(12) United States Patent
Schmitt

(10) Patent No.: US 8,550,834 B2
(45) Date of Patent: Oct. 8, 2013

(54) CIRCULAR PLUG-TYPE CONNECTOR

(76) Inventor: Fred R. Schmitt, Talheim (DE)

( * ) Notice: Subject to any disclaimer, the term of this patent is extended or adjusted under 35 U.S.C. 154(b) by 149 days.

(21) Appl. No.: 13/184,950

(22) Filed: Jul. 18, 2011

(65) Prior Publication Data

US 2012/0015539 A1 Jan. 19, 2012

(30) Foreign Application Priority Data

Jul. 19, 2010 (DE) ..... 20 2010 010 418 U

(51) Int. Cl.
*H01R 13/62* (2006.01)

(52) U.S. Cl.
USPC ..... 439/312

(58) Field of Classification Search
USPC ..... 439/578, 585, 312, 322, 792, 580–583
See application file for complete search history.

(56) References Cited

U.S. PATENT DOCUMENTS

| | | | | |
|---|---|---|---|---|
| 4,400,050 | A * | 8/1983 | Hayward | 439/585 |
| 4,593,964 | A * | 6/1986 | Forney et al. | 439/580 |
| 4,813,887 | A * | 3/1989 | Capp | 439/580 |
| 5,141,451 | A * | 8/1992 | Down | 439/585 |
| 5,439,386 | A * | 8/1995 | Ellis et al. | 439/322 |
| 5,499,934 | A * | 3/1996 | Jacobsen et al. | 439/585 |
| 5,797,761 | A | 8/1998 | Ring | |
| 6,210,222 | B1 * | 4/2001 | Langham et al. | 439/583 |
| 6,955,563 | B1 * | 10/2005 | Croan | 439/578 |
| 7,887,366 | B2 * | 2/2011 | Chee et al. | 439/585 |
| 8,272,893 | B2 * | 9/2012 | Burris et al. | 439/578 |
| 8,313,345 | B2 * | 11/2012 | Purdy | 439/578 |
| 8,323,060 | B2 * | 12/2012 | Purdy et al. | 439/792 |
| 8,337,229 | B2 * | 12/2012 | Montena | 439/322 |
| 2005/0175404 | A1 | 8/2005 | Conway | |

FOREIGN PATENT DOCUMENTS

| | | | |
|---|---|---|---|
| DE | 20 2005 017 981 | U1 | 2/2006 |
| DE | 10 2006 055 534 | B3 | 1/2008 |
| EP | 0 772 259 | A2 | 5/1997 |

OTHER PUBLICATIONS

European Search Report mailed Oct. 12, 2011 for the corresponding European application No. 11005612. (Without English translation).
EN 61076-2-101, Dec. 2003.

* cited by examiner

*Primary Examiner* — Jean F Duverne
(74) *Attorney, Agent, or Firm* — Leason Ellis LLP.

(57) ABSTRACT

A circular plug-type connector for a multi-core electrical cable, which is provided in each case with male or female contacts, possesses an inner insulating body for holding the individual male or female contacts in its interior. This insulating body is provided with its cable-side end region in a sleeve-shaped holding ring in such a way that it can be plugged in. A top piece can be fastened rotatably on the holding ring. The top piece is formed with a thread for connection to a mating plug-type connector. A sleeve-shaped housing, which can be assembled from at least two housing parts, can be fastened with its one axial end on the cable-side end region of the holding ring. The cable can be inserted into the housing and fastened thereon with resistance to tensile stress at the other axial end of the housing. A coupling unit comprising two circular plug-type connectors, which can be fastened detachably to one another using screws, for a multi-core electrical cable that is provided in each case with male or female contacts is characterized in that one circular plug-type connector has plug-type contacts and the other plug-type connector has female contacts.

22 Claims, 5 Drawing Sheets

10
12
26
72
146
144
156
26
15
13
36
32
22
11
47
148
45
60
75
74
102
106
132
104
106
18
16

10
32
22
60
44
36
12
26
158
11
144
29
28
72
140
142
75
47
34
32
30
22
60
75
148
74
102
152
45

CIRCULAR PLUG-TYPE CONNECTOR

CROSS-REFERENCE TO RELATED PATENT APPLICATIONS

This application is a U.S. patent application that claims priority to German Patent Application No. 20 2010 010 418.1, filed Jul. 19, 2010, which is incorporated by reference herein.

TECHNICAL FIELD

The invention relates to a circular plug such as is used, for example, as a standardized M12 plug-type connector in industrial device connection technology for signal transmission and for device power supply in each case of connected electrical devices.

PRIOR ART

In the case of the circular plug-type connector known from DE 20 2005 017 981 U1, the contacts which are fitted in each case at the end of the individual cable strands are held in a contact carrier, which comprises a plurality of component parts. Once they have been provisionally assigned to the individual contacts, these component parts need to first be assembled by being moved axially and rotated before they can then be inserted into the housing of the circular plug-type connector. The insulating body which accommodates the contacts and cannot be produced from an electrically conductive material, partially represents regions of the plug-type connector housing. This prevents a design of the circular plug-type connector which is safe from interference radiation.

The circular plug-type connector known from DE 10 2006 055 534 B3 also has a contact carrier assembled from a plurality of component parts. Its component parts comprise a carrier body having a plurality of half-open contact chambers which are aligned radially outwards, a sealing insert as fixing aid and a carrier sleeve. These three component parts which are produced from an electrically non-conductive material are assembled axially once the individual cable strands of the cable to be connected have been inserted into the half-open contact chambers in such a way as to be held there more or less provisionally. The electrical cable which has been inserted into the circular plug-type connector reaches with its sheath as far as into the electrically non-conductive carrier body. This means that a design of the circular plug-type connector housing which is safe from interference radiation is not ensured.

DESCRIPTION OF THE INVENTION

Against the background of this prior art, the invention is based on the object of specifying an improved circular plug-type connector of the type mentioned at the outset.

The invention is provided by the features of patent claim 1 and alternative independent patent claim 17. Expedient developments of the invention are the subject matter of further subsequent claims.

The circular plug-type connector according to the invention can be assembled very easily in an operationally safe manner. It is therefore merely necessary for correct arrangement of the individual conductors in the circular plug-type connector for the male or female contacts fastened on the individual conductors to be plugged in each case individually through the aperture provided in each case for them in a single-part insulating body. The contacts then become stuck with frictional engagement or in such a way that they hook into the apertures. The insulating body equipped in this manner can then be pushed axially into a top piece. The actual housing of the circular plug-type connector comprises a plurality of housing parts, such as in particular housing shells, which are fastened with their axial ends on the top piece and, in the process, then hold the insulating sleeve in its axial position in the top piece fixedly. The outer sleeve produced from electrically conductive material enables a design of the circular plug-type connector which is free from interference radiation. This also applies to a coupling unit screwed together from two such plug-type connectors.

More details relating to such circular plug-type connector housings, such as are known in particular generically as M12 plug-type connector housings, and the coupling unit produced therefrom can be gleaned from the features additionally mentioned in the claims and the exemplary embodiments below.

BRIEF DESCRIPTION OF THE DRAWING

The invention will be described in more detail and explained below with reference to the exemplary embodiments illustrated in the drawing, in which.

APPROACHES FOR IMPLEMENTING THE INVENTION

Figure 1:
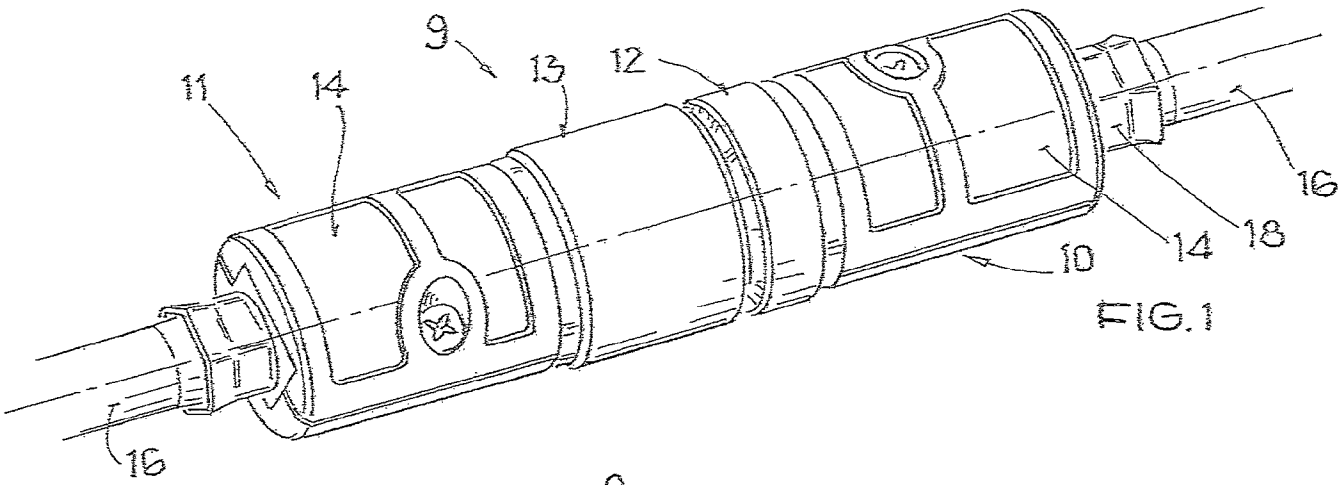
FIG. 1 shows a perspective view of two circular plug-type connectors screwed to one another to form a coupling unit.
Figure 2:
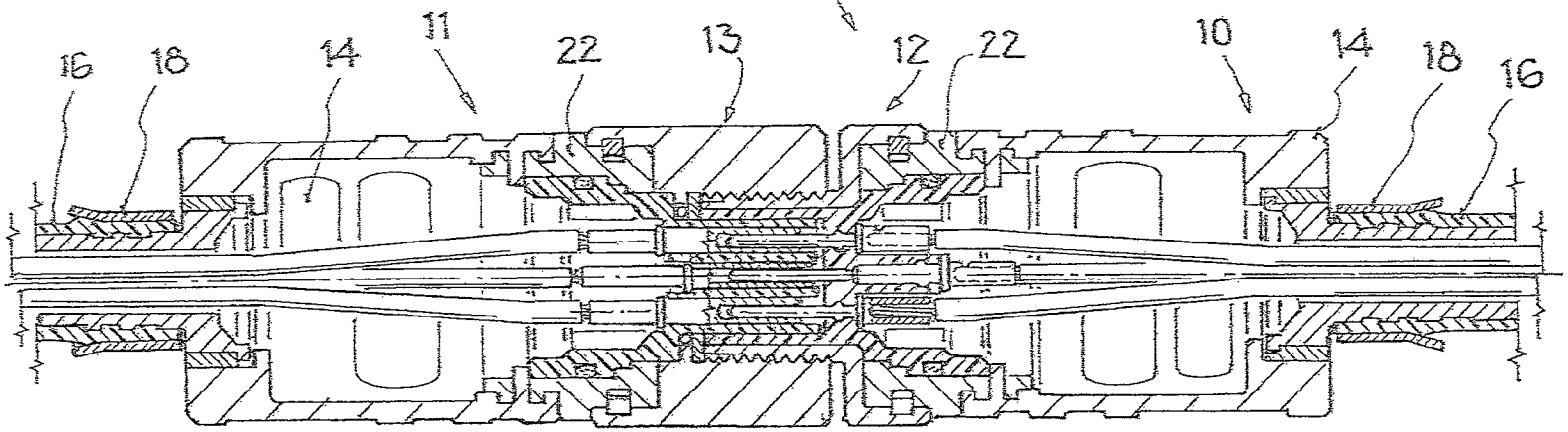
FIG. 2 shows a longitudinal section through the coupling unit shown in FIG. 1.

The coupling unit 9 illustrated in FIG. 1 and FIG. 2 comprises two circular plug-type connectors 10 and 11 screwed to one another. One of the two circular plug-type connectors, in the present example the circular plug-type connector 10, is equipped with male contacts. Correspondingly, the circular plug-type connector 11 is equipped with female contacts. Apart from their housing parts which are screwed to one another and their respective plug-type contact inserts, the two circular plug-type connectors have the same design.

The circular plug-type connector 10 according to the invention, and similarly the circular plug-type connector 11 is in the form of an M12 plug-type connector in accordance with IEC 61076-2-101 in the present example. It has a top piece 12, by means of which it can be connected to a correspondingly designed mating plug-type connector, such as to the circular plug-type connector 11 in the present example.

The circular (in cross section) top piece 12 is adjoined by a housing 14 having a comparable circular cross section. On the rear side thereof, the electrical cable 16 which has been passed into the interior of the housing 14 is shown. The electrical cable 16 is fastened on the housing 14 in a manner resistant to tensile stress and an HF-proof manner via a crimping connection, of which its crimping sleeve 18 is shown in FIG. 1. The braided shield of the cable which is not shown in the drawing is connected directly to the housing 14, as is known in the case of such crimping connection technology in the context of D-sub plug-type connector housings.

The top piece 12 of the circular plug-type connector 10 comprises a threaded sleeve 20. The threaded sleeve 20 is formed in one part and comprises a relatively small sleeve section 24 and a relatively large sleeve section 26. An external thread 28 is provided on the relatively small sleeve section 24, by means of which external thread the threaded piece 20 can be screwed to a mating plug-type connector.

Figure 4:
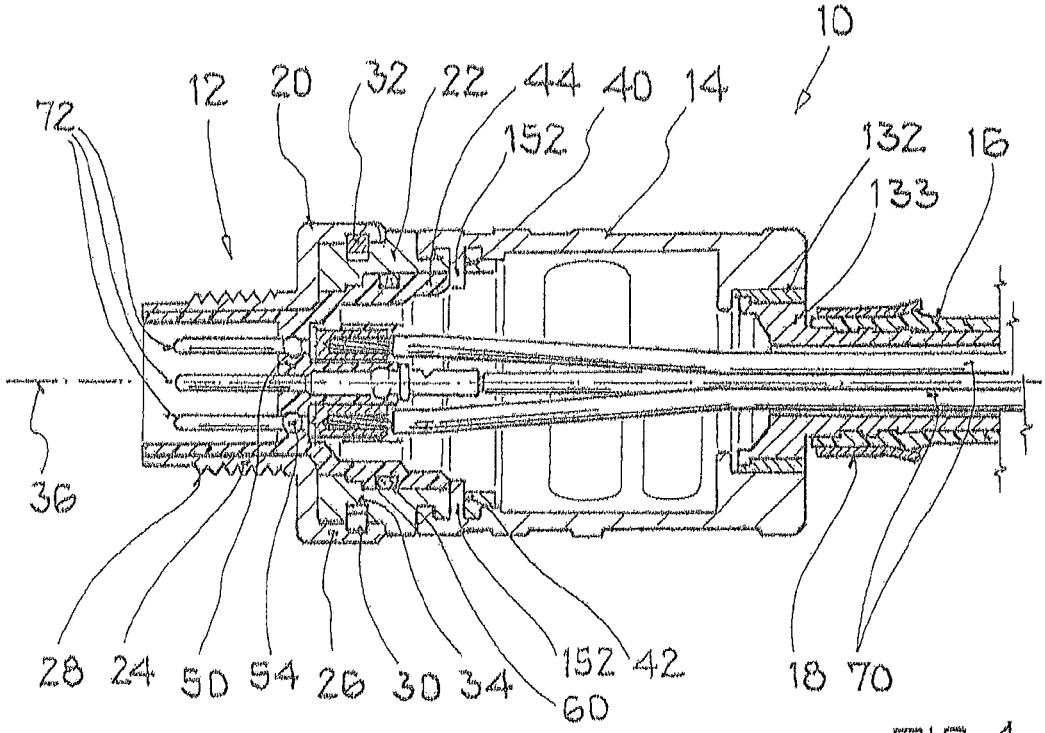
FIG. 4 shows a longitudinal section through the circular plug-type connector shown in FIG. 3.

A circumferential inner groove 30 is provided in the interior of the relatively large sleeve section 26 (FIG. 4). A slotted, ring-shaped holding spring 32 is inserted in the inner groove 30 with frictional engagement under stress. The relatively large sleeve section 26 surrounds a holding ring 22 on the outside.

The holding ring 22 is likewise sleeve-shaped, in the same way as the threaded sleeve 20, and has a circumferential outer groove 34. The holding spring 32 is located in said groove 34. When the holding ring 22 is pushed into the relatively large sleeve section 26 of the threaded sleeve 20, the threaded sleeve 20 can thus rotate back and forth as desired about the longitudinal axis 36 relative to the holding ring 22 owing to the presence of the holding spring 32. In this case, in the pushed-together state, the holding ring 22 sits firmly in the threaded sleeve 20 in the axial direction.

On that end of the holding ring 22 which is remote from the top piece 12, two mutually opposite slots 40, 42, which extend in each case slightly circumferentially, are provided in said holding ring. These slots are used for fastening the housing 14 on the holding ring 22 and therefore on the top piece 12, as will be described in more detail further below.

An insulating body 44 can be pushed into the top piece 12 in the axial direction (longitudinal axis 36). This insulating body 44 has, based on FIG. 5, a left sleeve section 46 of relatively small diameter and, adjacent thereto in the axial direction, a right sleeve section 48 of relatively large diameter. The two sleeve sections 46, 48 are connected to one another integrally via a transverse wall 50 (FIG. 4).

A plurality of, in the present example four, holes 52 are provided distributed circumferentially uniformly around the longitudinal axis 36 in the transverse wall 50. The holes 52 have such an inner contour that the contact which is pushed in each case through a hole 52 and in the present case is a male contact 72, with a spherical region 54 can be located with frictional engagement sufficiently fixedly in the axial direction. Instead of the spherical design of a respective contact 72 said contact should also rest in a hole 52 with a hook formation. The region of the transverse wall 50 is adjoined on the left (in FIG. 4) or in the direction out of the plane of the page (in relation to FIG. 6), by four longitudinal walls 56 which are arranged crosswise. They form a reinforcement of the outer sheath of the insulating body 44 in the region of its relatively large sleeve section 48. At the point of intersection between the four longitudinal walls 56, a further central aperture 52.2 is provided, through which a contact 72 can likewise be plugged. This contact also rests firmly with a spherical region in the hole which is elongated correspondingly in the axial direction. Owing to its relatively long length, this central contact is provided with a stepped formation cross-sectionally in the axial direction (FIG. 2).

The number of holes 52 in the transverse wall 50 and the central aperture 52.2 each correspond to the number of electrical conductors 70 (cores) of the cable 16. In the present case, five electrical conductors (cores) 70 are provided. In each case one male contact 72 is crimped onto the exposed ends of these conductors 70, in the present case. Instead of the male contacts 72, in each case female contacts 74 (FIG. 7) are crimped on in the case of the circular plug-type connector 11.

A circumferential groove 58 is provided on the outer side of the insulating body 44, with a sealing ring 60 being located in said groove and thus sealing the insulating body 44 with respect to the holding ring 22.

Figures 5, 6:
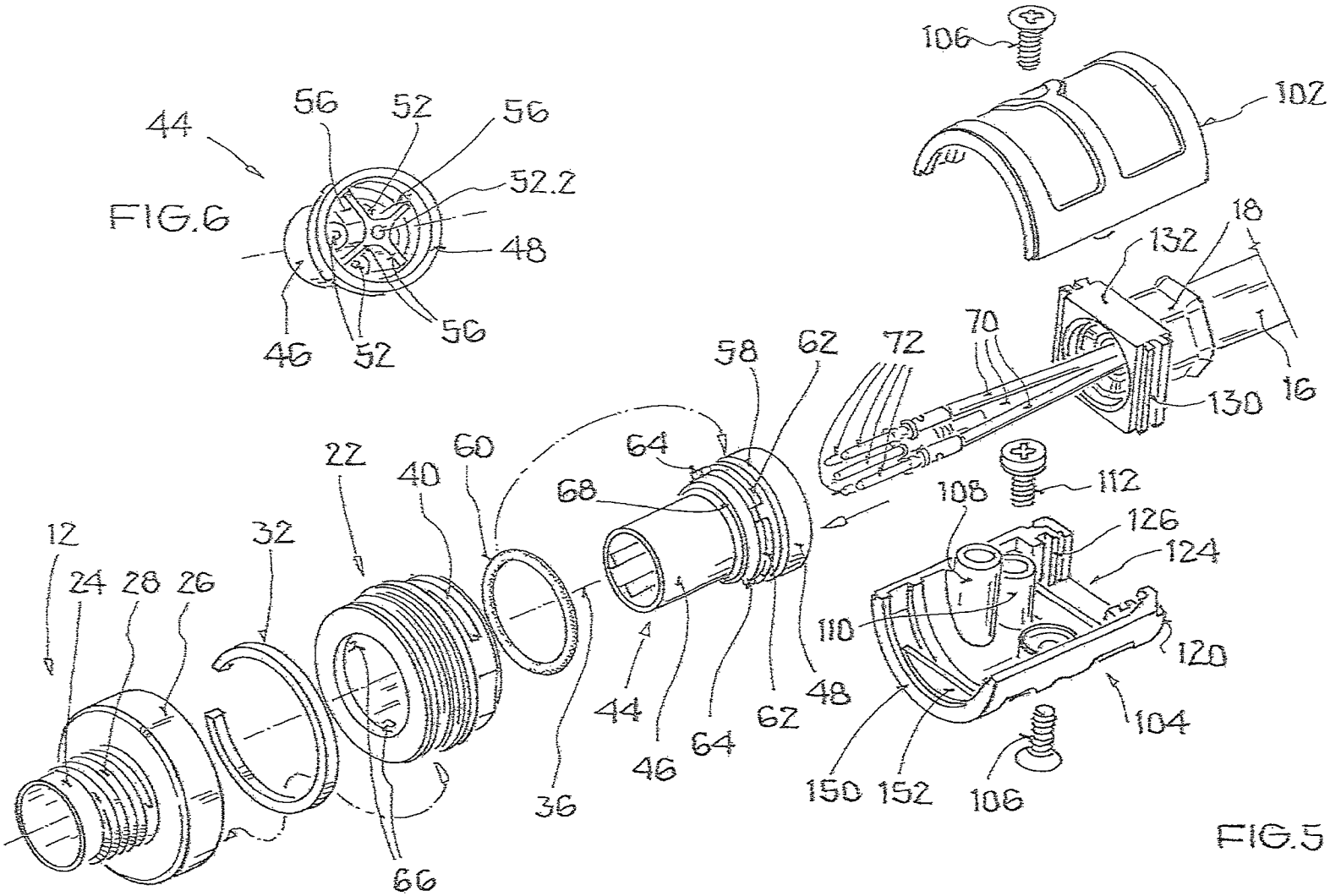
FIG. 5 shows an exploded illustration of the circular plug-type connector shown in FIG. 4.
FIG. 6 shows a perspective view from the rear of the insulating body which can be pushed into the circular plug-type connector shown in FIG. 5.

At an axial distance to the left of the circumferential groove 58 (in relation to FIG. 5) a plurality of, in the present case four, sectionally circumferential step-shaped tapered portions 62 are formed, which are separated from one another circumferentially by four wall regions 64 of the sheath of the insulating body 44. In each case one projection 66 protrudes into these step-shaped tapered portions 62 in the axial direction, said projection protruding in the axial direction on the inner wall of the holding ring 22. Two of these four projections 66 are shown in FIG. 5. The insulating body 44 resting in the holding ring 22 can therefore be rotated about the longitudinal axis 36 through a certain angle of rotation. In the present case, in which four projections 66 and correspondingly likewise four step-shaped tapered portions 62 are provided and engage in one another, the insulating body 44 can be rotated about the longitudinal axis 36 through less than 90°. Any further rotation is prevented by the projections 66, which bear against the wall regions 64 of the insulating body 44. As a result, the individual conductors 70 of the cable 16 cannot be rotated excessively with respect to one another.

The insulating body 44 also has a circumferential shoulder 68, with which it bears from the inside in the axial direction against the threaded sleeve 20, to be precise on the inner side of the transition region between its relatively small sleeve section 24 and its relatively large sleeve section 26. The insulating body 44 can therefore only be pushed towards the left (in relation to FIG. 4) into the threaded sleeve 20 until it bears against this transition region of the threaded sleeve 20. In the opposite direction (towards the right in relation to FIG. 4), the insulating body 44 cannot be moved; this is prevented by the two housing parts (half shells) of the housing 14 plugged onto the holding ring 22, as will be described in more detail further below.

In order to ensure correct positioning of the individual electrical conductors 70 in the insulating body 44, the individual holes 52, 52.2 thereof (FIG. 6) are provided with numbering (in the present case with the numbers 1, 2, 3, 4 etc.), on the inside as well as on the outside of the insulating body 44.

Figure 3:
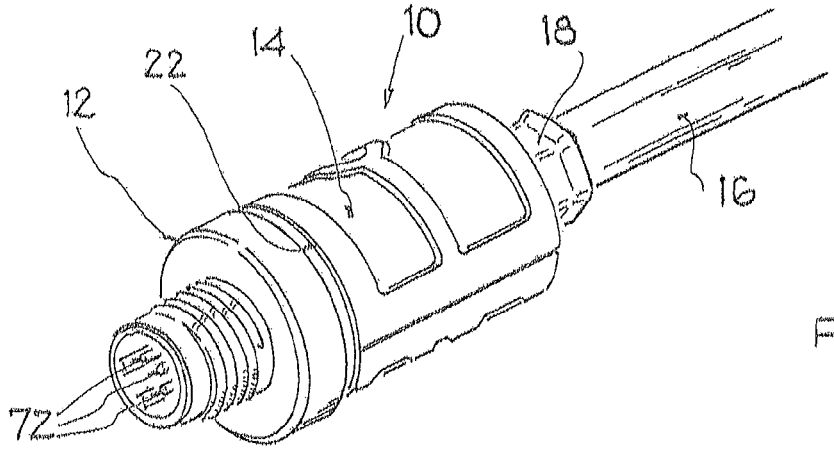
FIG. 3 shows a perspective view of a circular plug-type connector, containing male contacts, of the coupling unit shown in FIG. 1.

In the present case, the housing 14 comprises two equally sized, identical, trough-like housing parts 102, 104, which can be screwed together by means of (in the present case) two screws 106 to form the sleeve-like housing 14 (FIG. 3). For this purpose, a screw boss 108 matched to the screws 106 is provided in each housing part 102, 104. A further screw boss 110 provided in each housing part 102, 104 can be used for fastening a grounding line of the cable 16 by means of a further screw 112.

The lower half of a square (in cross section) cutout 124 is provided on the rear end side 120, facing the cable 16, of the lower housing part 104, and a comparable formation is provided in the case of the upper housing part 102. The interior surface 126 of this half cutout, and thus also the interior surface of the entire cutout 124 in the housing 14, has, in relation to the longitudinal axis 36 a meandering, zig-zag-like formation, which corresponds to the corresponding zig-zag-shaped outer face 130 of the crimping flange 132. That is to say that the crimping flange 132 also has such a zig-zag-shaped outer face 130 on two mutually opposite outer sides of its (in the present case) approximately square basic shape. The crimping flange 132 which has been inserted into the two housing parts 102, 104 has a very good clamping fit in the housing 14, with the result that, firstly, the crimping flange 132 has a fit in the housing 14 which is resistant to tensile stress and acts in the direction of the axis 36 and, furthermore, owing to the serrated interior surface 126 and the outer face 130 of the crimping flange 132, an HF-proof connection of the crimping flange 132 to the housing 14 is also provided.

The crimping flange 132 has a sleeve part 133, which dips into the cable 16 and envelops the electrical conductors 70 (FIG. 4) and which bears against the sheath of the cable 16 so as to press against it from the inside. The outer crimping sleeve 18 bears against the sheath of the cable 16 from the outside by virtue of corresponding deformation. The cable 16 is thus held in a manner resistant to tensile stress on the housing 14 by virtue of the inner sleeve part 133 and the outer crimping sleeve 18.

At an axially small distance, in each case one transverse wall 152 is provided on the other end side 150, which is at the front in the drawings, of the two trough-like housing parts (102, 104). In the assembled state of the circular plug-type connector 10, this transverse wall 152 engages in each case in one of the slots 40, 42, which are both provided in the holding ring 22 (FIG. 2, FIG. 4). The transverse walls 152 and the interior walls of the slots 40, 42 provided in the respective holding ring 22 have a slight wedge shape with respect to one another in order to ensure a contact-proof fit of the transverse walls 152 in the slots 40, 42.

Once the two housing parts 102, 104 have been screwed together by means of the (in the present case) two screws 106, the crimping flange 132 rests between said housing parts in a manner resistant to tensile stress. In addition, the two housing parts 102, 104 and therefore the housing 14 are fitted on the holding ring 22 such that they cannot rotate and cannot move axially. The two transverse walls 152 provided in the two housing parts 102, 104 protrude from the outside through the slots 40, 42 provided in the holding ring 22 and, in the process, bear against the insulating body 44 from the right (in relation to FIG. 4). The insulating body 44 is thus held immovably in its axial alignment.

The circular plug-type connector 11 differs from the circular plug-type connector 10 firstly by virtue of its insulating body 45, which is equipped with female contacts 74, and secondly, by virtue of its top piece 13, which is in the form of a union nut 15 at its axial front end.

Figures 7, 8:
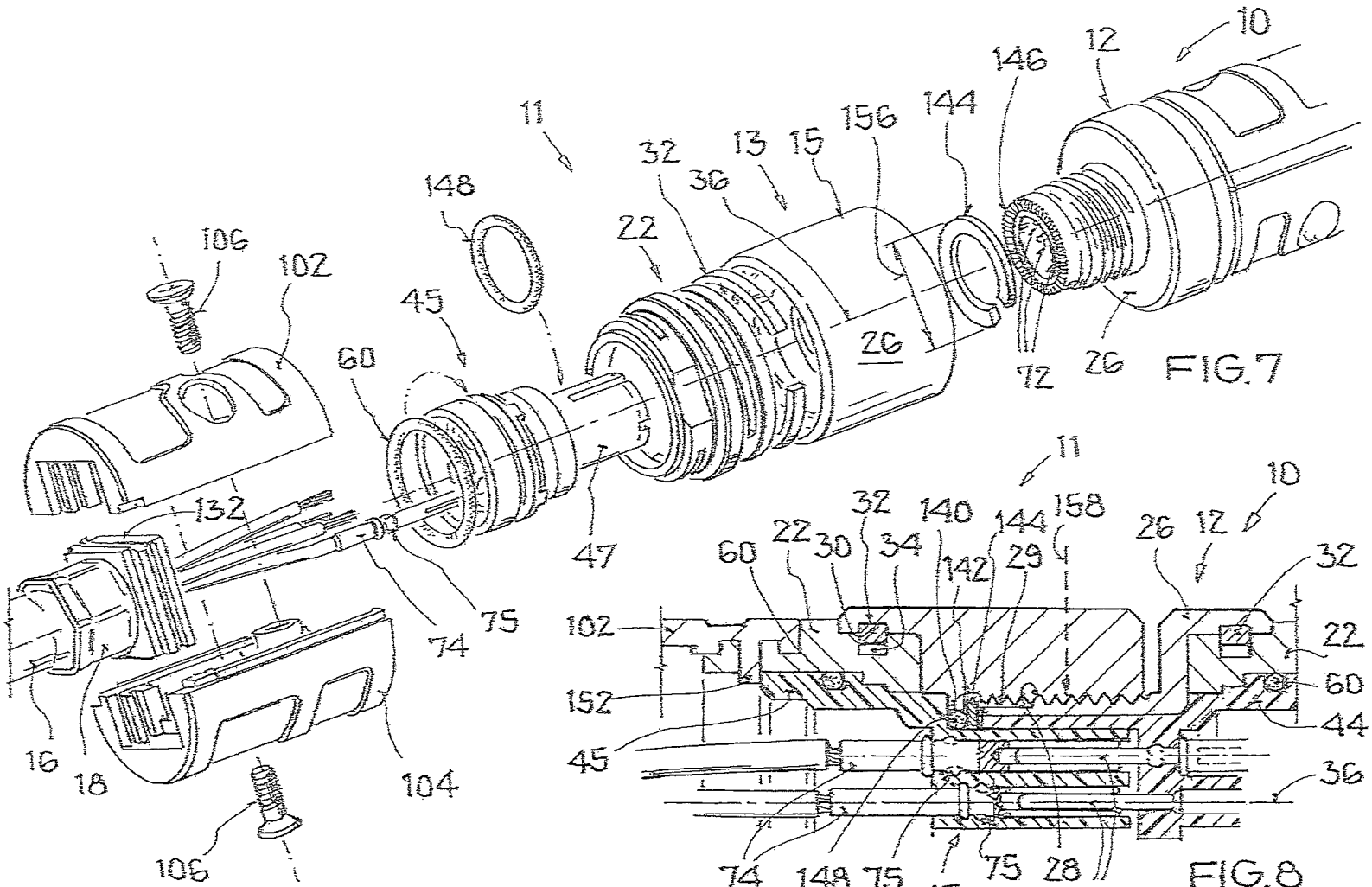
FIG. 7 shows a perspective illustration of the coupling unit shown in FIG. 1 with an exploded illustration of the circular plug-type connector containing female contacts.
FIG. 8 shows a partial view of the coupling region of the coupling unit shown in FIG. 2.

An internal thread 29, which is matched to the external thread 28 of the top piece 12, is formed in the interior of the union nut 15, with the result that the union nut 15 can be screwed onto the external thread of the top piece 12 and thus the two circular plug-type connectors 10, 11 can be screwed to one another. The resultant coupling unit is illustrated in section in FIG. 2 and in an enlarged partial section in FIG. 8. Furthermore, FIG. 7 shows the circular plug-type connector 10 in its assembled state and the circular plug-type connector 11 in its perspective exploded state.

The union nut 15 has, at its axial end, the same relatively large sleeve distance 26 that the top piece 12 of the circular plug-type connector 10 also has. As a result, the union nut 15 can be fastened on an identically formed holding ring 22 by means of a holding spring 32 in the same way as the top piece 12. The housing 14 with its two housing parts 102, 104 is in turn fastened on the holding spring 32, as already mentioned in connection with the circular plug-type connector 10. In the case of the circular plug-type connector 11 as well, the transverse walls 152 provided in the housing parts 102, 104 hold the insulting body 45 firmly in the axial direction, with the result that the insulating body 45 cannot be pushed or moved out of the holding ring 22 towards the left (in relation FIG. 8). In turn, a sealing ring 60 is inserted between the insulating body 45 and the holding ring 22.

The union nut 15 has an inner bead 140, which is provided circumferentially adjoining the internal thread 29, in the present example. An undercut 142 of the internal thread 29 is formed between the internal bead 140 and the inner end of the internal thread 29, with a slotted shaft ring 144 being positioned in the region of said undercut. This shaft ring 144, in the installed state illustrated in FIG. 2 and FIG. 8 bears in pressing fashion against the corrugated end side 146 of the top piece. It is pressed against the end side 146 of the internal bead 140 by virtue of the union nut 15 being screwed onto the top piece 12.

The internal bead 140 bears radially outwards so as to press against a sealing ring 148, which has been threaded onto the relatively small sleeve section 46 of the insulating body 45. The shaft ring 144 provided in the undercut 142 prevents the possibility of the sealing ring 148 being withdrawn from the insulating body 45 when the union nut 15 is unscrewed from the top piece 12.

By virtue of its pressing bearing arrangement, between the internal bead 140 and the relatively small sleeve section 47 of the insulating body 44, the shaft ring 144 ensures secure contact between these parts. An intended low-resistance connection between the two top pieces 12, 13 (produced from electrically conductive material) of the two circular plug-type connectors 10, 11 is thus provided. This low-resistance connection is additionally ensured by the threaded screw connection between the union nut 15 and the top piece 12. This contact produced by the screw connection is reinforced by the shaft ring 144 since said shaft ring presses the internal thread 29 of the union nut 15 and the external thread 28 of the top piece 12 against one another in the axial direction. The contact-ensuring bearing arrangement of the shaft ring 144 against the end side 146 is reinforced by the corrugated surface thereof.

In the present case, the outer diameter 156 of the shaft ring 144 is slightly larger than the inner diameter 158 of the internal thread 29 of the union nut 15. The slotted shaft ring 144 can be pressed together radially as it is fitted and screwed into the internal thread 29 to such an extent that it comes to lie in the undercut 142 in its state illustrated in FIG. 2 and FIG. 8. In this state, it is spread apart again and remains positioned in the undercut 142 immovably in the axial direction. As a result, it can hold the sealing ring 148 securely in region of the internal bead 140 when the union nut 15 is unscrewed from the top piece 12 and prevent the sealing ring 148 from being able to move in the axial direction when the screw connection is detached.

In the interior of its relatively small sleeve section 47, the insulating body 45 is in the form of a solid body, with longitudinal through-bores for accommodating the female contacts 74. Each female contact 74 has (similarly to the male contacts 72) a spherical region 75 with which it can find space in the respective longitudinal through-bore in the relatively small sleeve section 47 of the insulating body 45 with frictional engagement and sufficiently fixedly in the axial direction. Instead of the spherical formation, it is also possible for a hook formation to be provided (as in the case of male contacts).

The coupling unit illustrated in FIG. 2 and comprising two circular plug-type connectors 10, 11 screwed to one another minimizes the interference radiation along the cables 16 which are connected to one another. This is achieved firstly by the low-resistance connection between the cable braiding (not illustrated in the drawing) of the cable 16, via the crimping flange 132, with the housing 14 and secondly by the cable input side, which is without an air gap and is therefore HF-proof, of the respective housing 14.

Furthermore, the low-resistance connection between the two crimping flanges 132 of the two plug-type connectors 10, 11 is ensured continuously in the axial direction via the housing parts consisting of metallic material. Thus, both the housing parts of the housings 14 and the respective holding ring 22 and the union nut 15 or the top part 12 are made from metallic material. In addition, these parts bear against one another in the axial direction providing fixed contact. The low-resistance connection between the union nut 15 and the top piece 12 is additionally reinforced not only via the threaded screw connection 28, 29 of these two parts but also by the pressing bearing arrangement of the shaft ring 144 between the internal bead 140 of the union nut 15 and the corrugated end side 146 of the top piece 12.

In the present case, only one cable 16 passes into the respective circular plug-type connector 10, 11. It would also be possible for the end side 120 of a housing, which corresponds functionally to the housing 14 to be so large that a plurality of, for example two, cables could be fastened on the housing via in each case individual crimping flanges 132 in a comparable manner. In this way, a plurality of cables could be passed into a corresponding housing. The front end side 150 of the housing could still have a contour which is matched circumferentially to the relevant top piece 12 or the union nut 15.

Figure 9:
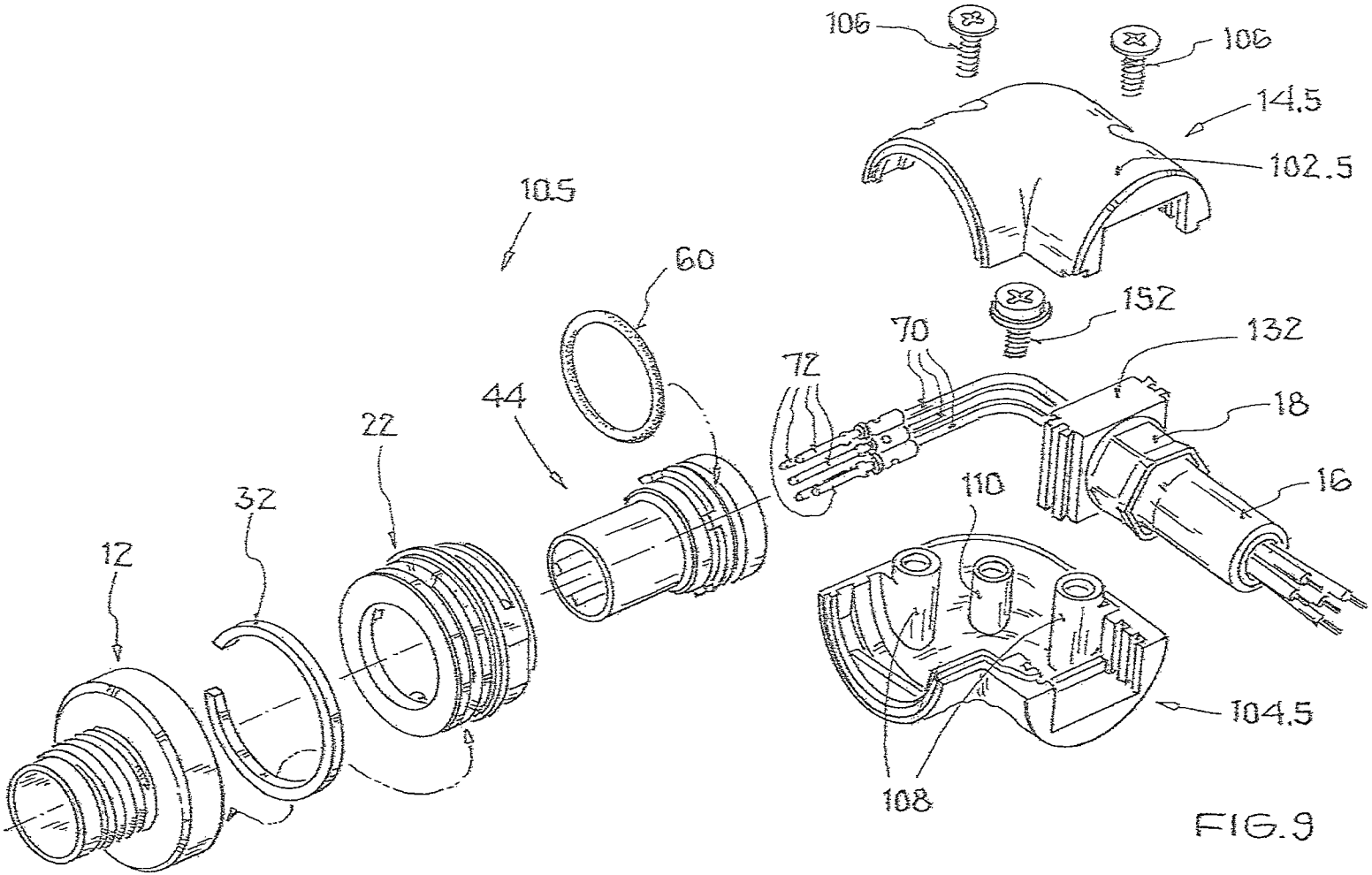
FIG. 9 shows an exploded illustration of a circular plug-type connector similar to that shown in FIG. 5, with a housing bent back through 90°.

Instead of a rectilinear axial alignment of the housing 14, the housing 14.5 illustrated in FIG. 9 has a shape bent through 90°, on the other hand. The top piece 12, the holding ring 22 and the insulating body 44 correspond to the parts illustrated in the previous figures; they are also unchanged in the case of the circular plug-type connector 10.5 illustrated in FIG. 9. The two wall-like housing parts are not identical in the bent embodiment, however. Thus, the two screw bosses 108 formed for the screw connection of the two housing parts and the screw boss 110 provided for fastening a grounding line are formed in one housing part, in the present example the lower housing part 104.5. Two apertures for two screws 106 are provided in the upper housing part 102.5, it being possible to use said screws to fixedly screw the upper housing part 102.5 onto the lower housing part 104.5. The crimping connection technology of the cable 16 corresponds to that for the axially straight housing 14 illustrated in FIG. 5.

The bent shape of the housing 14.5 can also be provided in the case of the circular plug-type connector 11.

As has already been mentioned above, the coupling unit 9 is produced from electrically conductive material and in this case its two housings 14, 14.5 are produced from die-cast zinc. In order to minimize the interference radiation not only in the region of the cables introduced into the housings but also in the region of the housings, the braided shield of each cable is connected electrically conductively to the coupling unit, which is likewise electrically conductive. This is achieved by a crimping flange system known in connection with D-sub plug-type connector housings. In this case, not only a low-resistance connection between the respective braided shield and the relevant housing but also, as a result of there being no air gap present, effective HF sealing of the relevant cable inlet are ensured. With such a crimping flange system, furthermore, any cable can be fastened on the housings in a manner resistant to tensile stress and in a pressure-tight manner.

CITATIONS CONTAINED IN THE DESCRIPTION

This list of documents cited by the applicant has been automatically generated and is included exclusively to provide better information for the reader. The list does not constitute part of the German patent or utility model application. The German Patent and Trade Mark Office does not undertake any liability for any errors or omissions.

Cited Patent Literature

DE 202005017981 U1 [0002]
DE 102006055534 B3 [0003]

Cited Non-Patent Literature

IEC 61076-2-101[0019]

The invention claimed is:

1. Circular plug-type connector for a multi-core electrical cable, which is provided in each case with male or female contacts, comprising an inner insulating body for holding the individual male or female contacts in its interior, a holding ring surrounding said insulating body such that its cable-side end region can be plugged in to said holding ring, at least one slot being provided in the holding ring a top piece which can be fastened rotatably on the holding ring, the top piece being formed with a thread for connection to a mating plug-type connector, a sleeve-shaped housing which can be assembled from at least two housing parts and which, can be fastened with its one axial end on the cable-side end region of the holding ring, said housing having an axial section in the direction of the cable and transverse walls at the plug side and cable side, at least one cutout is provided in the cable side transverse wall in such a way that a crimping flange can be inserted into the interior surface of said cable side cutout in order to connect the cable to the connectors in a manner resistant to tensile stress and high frequency interference, when the connector is assembled the plug side transverse walls protrude into a slot in the holding ring in the radial direction and, in the process, rests therein in such a way that the holding ring is incapable of rotating and moving in the axial direction with respect to the housing, whereby the cable is fastened to the connector with resistance to tensile stress.

2. Circular plug-type connector according to claim 1, characterized in that the top piece has a threaded sleeve with a relatively small and a relatively large (in terms of outer diameter) sleeve section, that region of the insulating body which accommodates the ends of the male or female contacts can be plugged into the relatively small sleeve section which has an external thread that can connect to the threads of a mating plug-type connector, a circumferential inner groove is provided in the relatively large sleeve section, a securing ring can be inserted into a groove which runs circumferentially around an end region of the holding ring on the outside in such a way that, in the plugged-together state of the threaded sleeve and the holding ring, the securing ring can be placed in the inner groove of the relatively large sleeve section and thus the threaded sleeve is provided such that it can be rotated relative to the holding ring.

3. Circular plug-type connector according to claim 1, characterized in that the top piece has a threaded sleeve with a relatively small and a relatively large (in terms of inner diameter) sleeve section, an internal thread is provided in the relatively small sleeve section that can connect to the threads of a mating plug-type connector, a circumferential inner groove is provided in the relatively large sleeve section, a securing ring can be inserted into a groove which runs circumferentially around an end region of the holding ring on the outside in such a way that, in the plugged-together state of the threaded sleeve and the holding ring, the securing ring can be placed in the inner groove of the relatively large sleeve section and thus the threaded sleeve is provided such that it can be rotated relative to the holding ring.

4. Circular plug-type connector according to claim 1, characterized in that that axial end region of the insulating body which accommodates the male contacts is in the form of a sleeve which protrudes axially from an inner transverse wall, a plurality of apertures are provided in the transverse wall, a male contact which is fastened on a cable strand can be inserted in each of these apertures in such a way that it can be held.

5. Circular plug-type connector according to claim 1, characterized in that that axial end region of the insulating body which accommodates the female contacts is in the form of a solid body which contains axial through-bores accommodating the female contacts and adjoins an inner transverse wall.

6. Circular plug-type connector according to claim 4, characterized in that the respective contact has a spherical region, with which it can be pushed, with frictional engagement, into an aperture in the transverse wall or into a longitudinal through-bore in an insulating body.

7. Circular plug-type connector according to claim 4, characterized in that the respective contact has an at least sectionally radially circumferential projection, the aperture or the longitudinal through-bore has an at least sectionally radially circumferential enlarged portion such that the contact can be pushed in the axial direction into the transverse wall so as to hook into the enlarged portion.

8. Circular plug-type connector according to claim 1, characterized in that the housing is in particular circular in cross section and comprises at least two two equally sized housing parts, which can be fastened to one another by at least one screw, the top piece and holding ring can be fastened on the plug end side of the housing, the at least one cutout for a crimping flange is provided on the cable end side of the housing.

9. Circular plug-type connector according to claim 1, characterized in that the two housing parts are two approximately identically sized half shells.

10. Circular plug-type connector according to claim 1, characterized in that in the state in which the insulating body is plugged into the top piece,the insulating body bears with its cable-side end in the axial direction against a transverse wall of the housing.

11. Circular plug-type connector according to claim 1, characterized in that a circumferential groove is provided on the outer side of the insulating body, it being possible for a sealing ring to be inserted in said groove.

12. Circular plug-type connector according to claim 1, characterized in that a plurality of, in particular four, sectionally circumferential, step-shaped tapered portions are provided on the outer side of the insulating body, stud-like or pin-like projections, which protrude in the axial direction and correspond to the number of tapered portions are provided on a step-shaped shoulder of the inner wall of the holding ring, said projections protruding in the axial direction into the tapered portions of the insulating body and thus permitting a circumferentially limited rotation of the insulating sleeve in the holding ring and top piece.

13. Circular plug-type connector according to claim 8, characterized in that the housing has an approximately equally sized cross section in the axial direction and is provided in straight or bent-back form in the axial direction.

14. Circular plug-type connector according to claim 1, characterized in that the housing parts of the housing consist of an electrically conductive material, such as in particular die-cast zinc, the inner insulating body consists of an electrically non-conductive material, such as in particular a plastics material, the holding ring and the top piece consist of an electrically conductive material.

15. Coupling unit according to claim 1 comprising two circular plug-type connectors, which can be fastened detachably to one another using screws, for a multi-core electrical cable, which is provided in each case with male or female contacts, characterized in that one circular plug-type connector has plug-type contacts and the other circular plug-type connector has female contacts.

16. Coupling unit according to claim 15, characterized in that a contact ring is provided so as to press axially against the end side of one of the two top pieces.

17. Coupling unit according to claim 16, characterized in that the contact ring is in the form of a shaft ring.

18. Coupling unit according to claim 16, characterized in that the contact face of the top piece, against which the contact ring bears in pressing fashion, has an approximately corrugated surface, at least in regions.

19. Circular plug-type connector according to claim 5, characterized in that the respective contact has a spherical region with which it can be pushed, with frictional engagement, into an aperture in the transverse wall or into a longitudinal through-bore in an insulating body.

20. Circular plug-type connector according to claim 5, characterized in that the respective contact has an at least sectionally radially circumferential projection, the aperture or the longitudinal through-bore has an at least sectionally radially circumferential enlarged portion such that the contact can be pushed in the axial direction into the transverse wall so as to hook into the enlarged portion.

21. Coupling unit according to claim 17, characterized in that the contact face of the top piece, against which the contact ring bears in pressing fashion, has an approximately corrugated surface, at least in regions.

22. Circular plug-type connector according to claim 1, characterized in that the top piece is a union nut with an internal threaded section, wherein the internal threaded section can connected to the threads of a mating plug-type connector.

* * * * *